US008443542B1

(12) United States Patent
Galbraith

(10) Patent No.: US 8,443,542 B1
(45) Date of Patent: May 21, 2013

(54) FIRING PIN SIGHTING SYSTEM

(76) Inventor: Shaun W. Galbraith, Tyler, TX (US)

( * ) Notice: Subject to any disclaimer, the term of this patent is extended or adjusted under 35 U.S.C. 154(b) by 0 days.

(21) Appl. No.: 13/548,320

(22) Filed: Jul. 13, 2012

(51) Int. Cl.
*F41G 1/00* (2006.01)

(52) U.S. Cl.
USPC ..... 42/132; 42/113; 42/116; 42/134; 42/144; 42/145

(58) Field of Classification Search
USPC ..... 42/111, 113, 116, 132, 134, 135, 42/144, 145
See application file for complete search history.

(56) References Cited

U.S. PATENT DOCUMENTS

| | | | | |
|---|---|---|---|---|
| 953,696 | A * | 4/1910 | Konig | 359/428 |
| 2,773,309 | A | 12/1956 | Elliott | |
| 2,794,363 | A | 6/1957 | Parsitt | |
| 3,782,832 | A | 1/1974 | Haeskaylo | |
| 4,697,366 | A | 10/1987 | Frisoli | |
| 5,359,800 | A | 11/1994 | Fisher et al. | |
| 5,365,669 | A | 11/1994 | Rustick et al. | |
| 6,360,472 | B1 | 3/2002 | Lorocco | |
| 6,367,189 | B1 * | 4/2002 | Clay | 42/145 |
| 6,389,730 | B1 | 5/2002 | Millard | |
| 6,604,315 | B1 | 8/2003 | Smith et al. | |
| 7,065,917 | B2 | 6/2006 | Lahti | |
| 7,509,766 | B2 | 3/2009 | Vasquez | |
| 7,627,976 | B1 | 12/2009 | Olson | |
| 7,739,825 | B2 | 6/2010 | LoRocco | |
| 7,905,043 | B2 | 3/2011 | Hopkins | |
| 7,908,783 | B2 | 3/2011 | Howe et al. | |
| 8,117,780 | B2 * | 2/2012 | Matthews et al. | 42/114 |
| 8,161,675 | B2 | 4/2012 | Sne et al. | |
| 8,189,967 | B1 * | 5/2012 | Olson | 385/12 |
| 2010/0011648 | A1 * | 1/2010 | Hopkins | 42/116 |
| 2010/0088944 | A1 | 4/2010 | Callihan | |
| 2011/0314721 | A1 * | 12/2011 | Lamb | 42/145 |
| 2012/0186129 | A1 * | 7/2012 | Sne et al. | 42/111 |

* cited by examiner

*Primary Examiner* — Samir Abdosh
*Assistant Examiner* — Derrick Morgan
(74) *Attorney, Agent, or Firm* — Eric C. Schmalbach

(57) ABSTRACT

Apparatus and method for a firing pin sight system. At least one rearwardly facing sight is located at a rear contact surface of a firing pin of a firearm. The at least one rearwardly facing sight is viewable to a shooter from the rear of the firearm. The at least one rearwardly facing sight forms a high contrast surface (in respect the rear surface of the firearm) allowing the shooter to align the at least one rearwardly facing sight point with a target located in front of said firearm. An optical alignment signaling indicia indicates to the shooter when the aim line of the handgun is either off-sight alignment or on-sight alignment.

22 Claims, 11 Drawing Sheets

FIRING PIN SIGHTING SYSTEM

BACKGROUND

The present invention relates to sighting devices for firearms, and more particularly, a rear sight located at a firing pin of a firearm.

Firearms, including handguns, traditionally employ at least one front sight located above the barrel, on the main body. A rear sight is used to bracket the front sight, while ensuring the sights are aligned within the same plane. Conventional handgun sighting practice stresses that the shooter focus on the front sight, located several millimeters above the barrel axis, as shown in FIG. 1. Several problems arise due to such sighting systems, including: the creation of ligature points along the handgun sighting surfaces; increased weight due to such sighting systems; and decreased situational awareness due to optical focus on the front sight.

Sighting devices have been known to use tritium light sources and fiber optic segments. Such devices are mounted on the main body of the weapon, and as such suffer from "parallax error" due to the sight being offset from the aim line of the barrel. In addition, such devices add ligature surfaces and weight to the weapon.

Other devices utilize bore sighting solutions, allowing laser sighting down the barrel of a weapon. However, such devices are not capable of being used during actual firing of the weapon.

U.S. Pat. No. 7,905,043 is directed towards a laser aiming system for firearms. However, special ammunition is required during use as well as the incorporation of reflective mirrors and prisms. Such structures would additionally add weight to the system and cause the shooter to focus on a point which is located further than the front sight.

Accordingly, it is desirable to employ a system which: allows a user to maintain a wide field of vision during target acquisition thereby increasing situational awareness; decreases excess weight to the weapon; and limits the number of external ligature surfaces. Therefore, a need arises for a sighting system addressing the aforementioned problems.

SUMMARY

Embodiments of the invention solve the need for a sighting system which allows a user to maintain a wide field of vision during target acquisition thereby increasing situational awareness; decreases excess weight to the weapon; and limits the number of external ligature surfaces. According to embodiments of the invention, a firing pin sighting system implements at least one rearwardly facing sight, located at a rear contact surface of a firing pin of a firearm. The at least one rearwardly facing sight is viewable to a shooter from the rear of a firearm. The at least one rearwardly facing sight forms a high contrast surface (in respect the rear surface of the firearm) allowing the shooter to align the at least one rearwardly facing sight point with a target located in front of the firearm.

In an exemplary embodiment, the at least one rearwardly facing sight is disposed within a circumposed recessed concavity located at the rear contact surface of the firing pin. The rearwardly facing sight is located at a lower recess surface within the circumposed recess concavity.

According to the embodiment, the rearwardly facing sight further defines an optical alignment signaling indicia, indicating to the shooter when the aim line of the firearm is either off-sight alignment or on-sight alignment. The optical alignment signaling indicia defines an alignment ring, wherein the rearwardly facing sight is concentrically circumposed within the alignment ring. When the barrel is off-sight, the alignment ring appears as a crescent, with an arc of the alignment ring concealed by the concentric recess wall. The portion of the arc of the alignment ring concealed by the concentric recess wall corresponds with the direction of deviation. When the muzzle is on-sight, the alignment will appear as a concentric ring around the sight point. The optical alignment signaling indicia allows the shooter to adjust the firearm such that the at least one rearwardly facing sight is aligned with the aim line of the firearm.

It is an object of the invention to provide a sighting system reducing external ligature surfaces on the external surfaces of a firearm.

It is yet another object of the invention to provide a sighting system which reduces the overall weight of a firearm.

It is yet another object of the invention to allow a shooter increased situational awareness and increased field of view during target acquisition, sighting, and firing of a firearm.

It is yet another object of the invention to provide at least one rearwardly facing sight located at the firing pin of a firearm.

It is yet another object of the invention to provide an optical alignment signaling indicia allowing a shooter to level the firearm such that the at least one rearwardly facing sight is aligned with the aim line of the firearm.

BRIEF DESCRIPTION OF THE DRAWINGS

These and other features, aspects and advantages of embodiments of the invention will become better understood with regard to the following description, appended claims, and accompanying drawings where:

DETAILED DESCRIPTION

Figure 1:
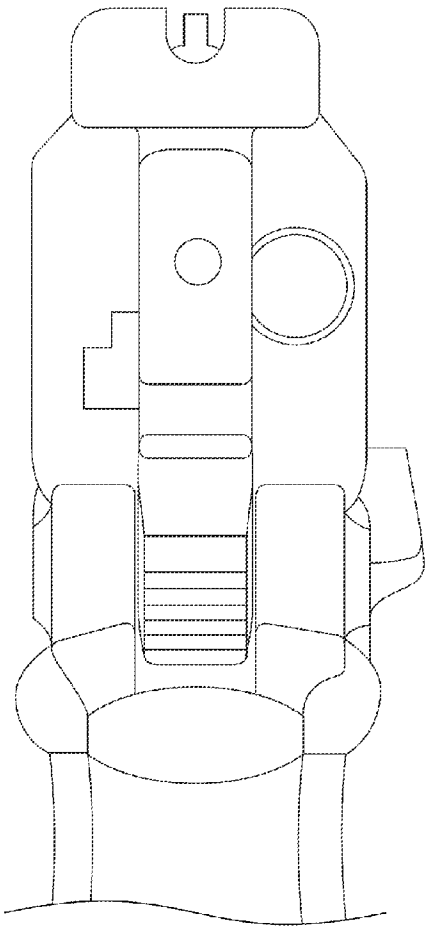
FIG. 1 PRIOR ART
FIG. 1 is a rear view of the prior art showing the rear of a pistol with top sights attached.

Referring to FIGS. 2-9, a firing pin sighting system 10 in accordance with the present invention is shown. The firing pin sighting system 10 is preferably adapted for use with a handgun 11. In the present example, the handgun 11 has a main body 12, defining a slide 13 and chassis 14, a barrel 15, a hammer 17, a grip 18, and a firing pin sighting arrangement 20. The handgun 11 illustrated in the preferred embodiment illustrates a 1911 style pistol. However, embodiments of the invention may be employed by any suitable type of handgun.

Figure 6:
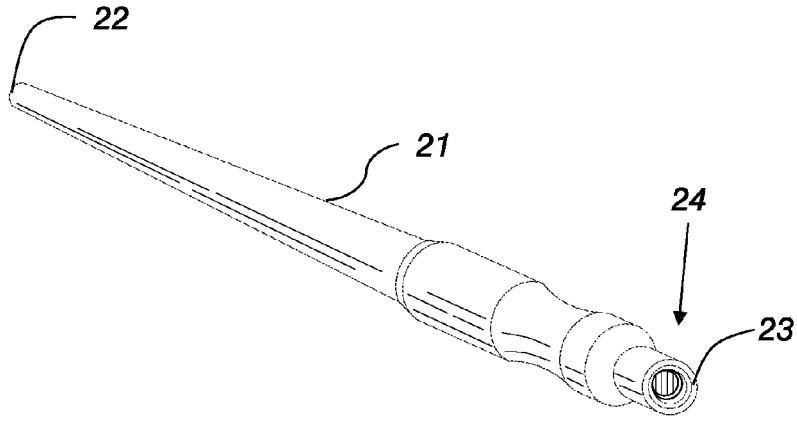
FIG. 6 is a perspective view of a firing pin sighting arrangement according to the embodiment of FIG. 1.
Figure 7:
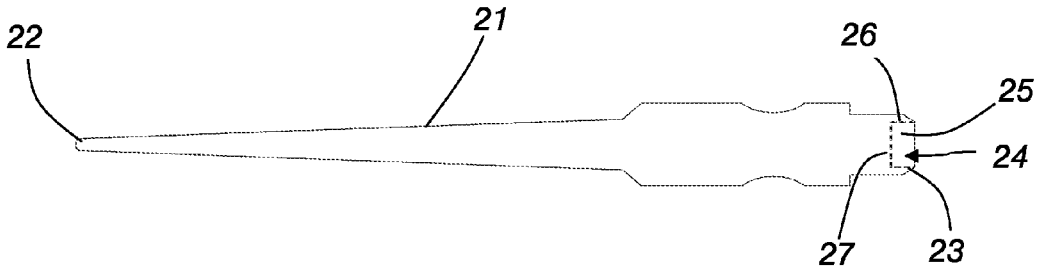
FIG. 7 is a partial cross-sectional side view of a firing pin arrangement according to the embodiment of FIG. 1.

A perspective view of the firing pin sighting arrangement 20 is shown in FIG. 6. A firing pin sighting arrangement 20 defines a firing pin 21 having a distal tip 22 and rear contact surface 23, and a high contrast sight 24 disposed within the rear contact surface 23. As shown in FIG. 7, the rear contact surface 23 defines a circumposed recessed concavity 25 and a concentric recess wall 26 extending into the firing pin 21 from the rear contact surface 23 towards the distal tip 22, creating a lower recess surface 27. The high contrast sight 24 is disposed within the recessed concavity 25, as shown in FIG. 7. The high contrast sight 24 of the preferred embodiment circular painted dot of a selected color, such as greed, red yellow, blue, or white, for example. The high contrast sight 24 may also be a number of high contrast light reflective materials such as radioluminous light elements, tritium coated surfaces, phosphorescent material, optically transparent plastic, or fiber-optic plastic, for example.

Figure 4:
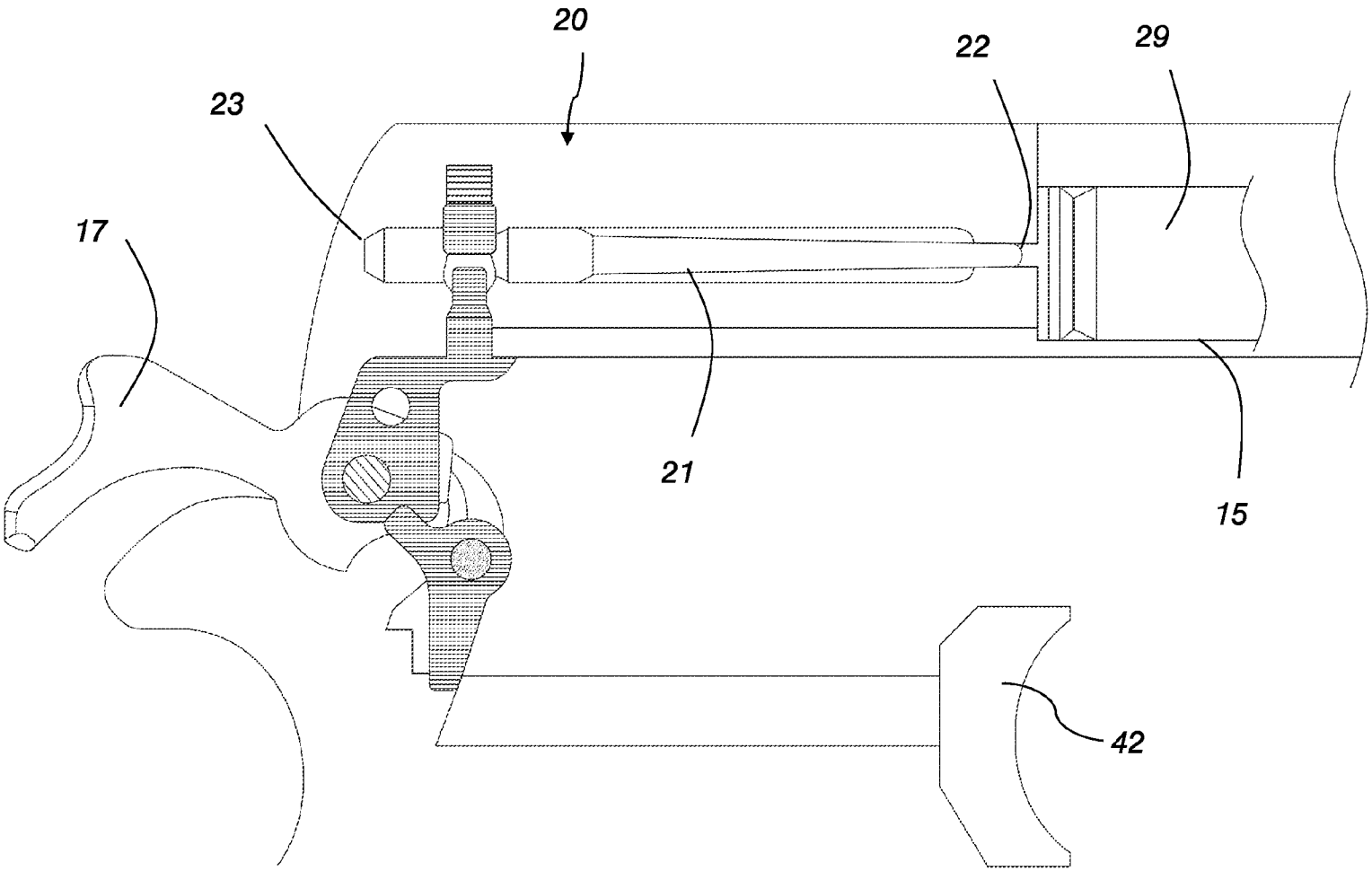
FIG. 4 is a cross-sectional side view of the firing pin sighting system according to the embodiment of FIG. 1.

Referring to FIG. 4, the firing pin 21 is positioned for reception of the hammer 17. The hammer 17 is pivotably mounted to strike the rear contact surface 23, causing the distal tip 22 of the firing pin 21 to strike a chambered round 29 when the trigger 42 is pulled, causing a shot to be fired.

Figure 2:
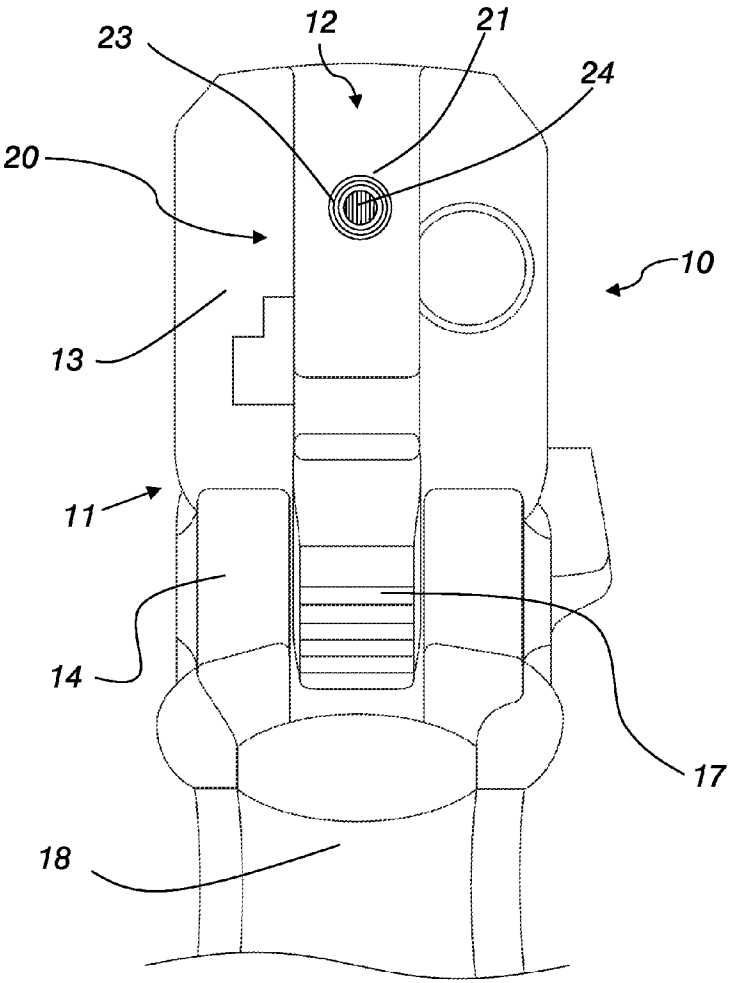
FIG. 2 is a rear view of a firing pin sighting system of an embodiment of the invention.
Figure 3:
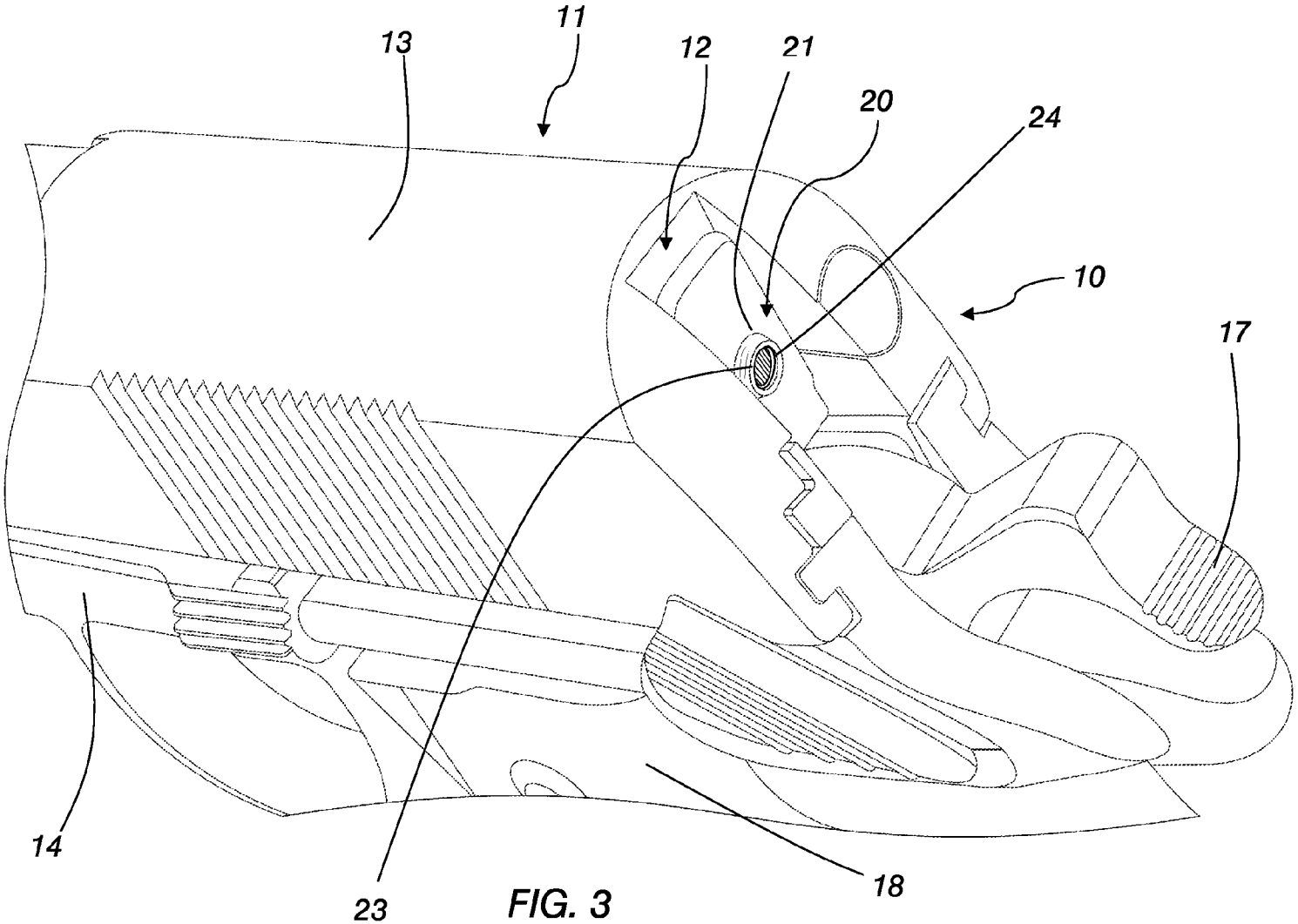
FIG. 3 is a perspective view of the firing pin sighting system according to the embodiment of FIG. 1.

As shown in FIGS. 2-3, the firing pin sighting arrangement 20 is visible to the shooter when the hammer 17 is cocked and ready to fire. According to the present example, front and rear sights (not shown) are removed from the handgun 11 to reduce weight and ligature surfaces while drawing the weapon.

Figure 5:
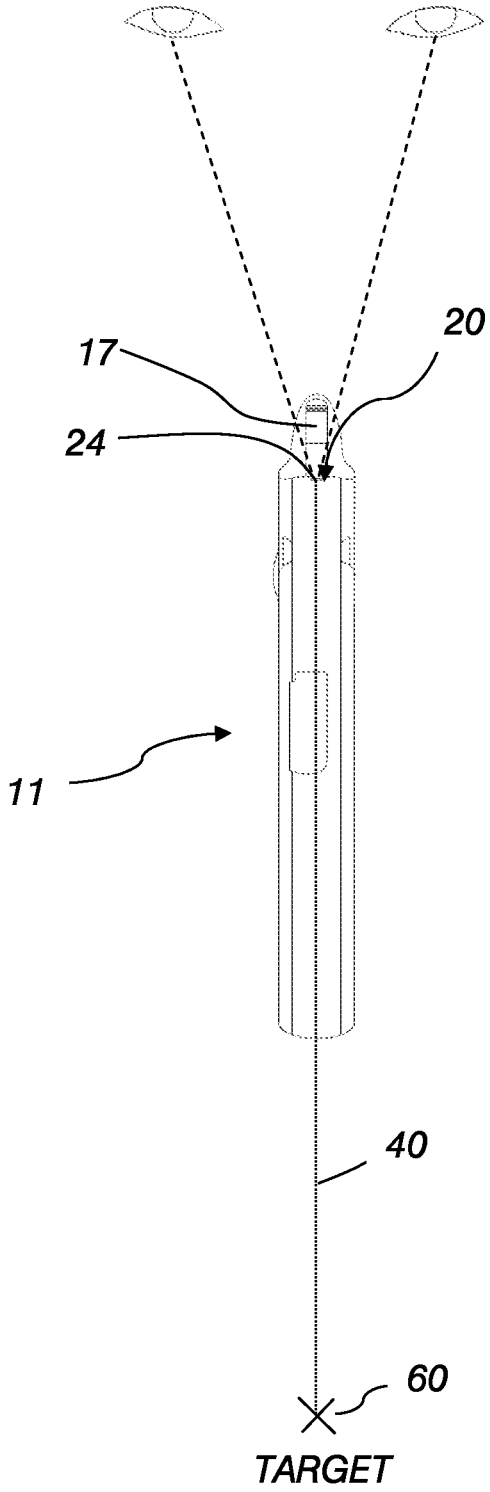
FIG. 5 is a schematic top view of an illustration of the firing pin sighting system according to the embodiment of FIG. 1, showing a cocked hammer, and aiming of a handgun.

Referring to FIG. 5, the shooter draws the handgun 11 and uses both eyes stereoscopically to acquire a target 60. The shooter focuses on the high contrast sight 24, and such focusing causes the high contrast sight 24 to be optically projected onto the target 60 from the perspective of the shooter. Accordingly, the shooter is allowed to quickly draw, acquire, and aim the handgun without having to align front and rear sights.

Target acquisition and sighting require that the shooter align the high contrast sight 24 with the target 60. The firing pin sighting arrangement 20 is concentrically aligned with the aim line 40 (as shown in FIG. 5), thereby allowing the firing pin sighting arrangement 20 to be aligned with the path of the bullet during its travel through the barrel 15. Accordingly, the firing pin sighting arrangement 20 must also be aligned with the aim line 40 for correct sighting.

Figure 8:
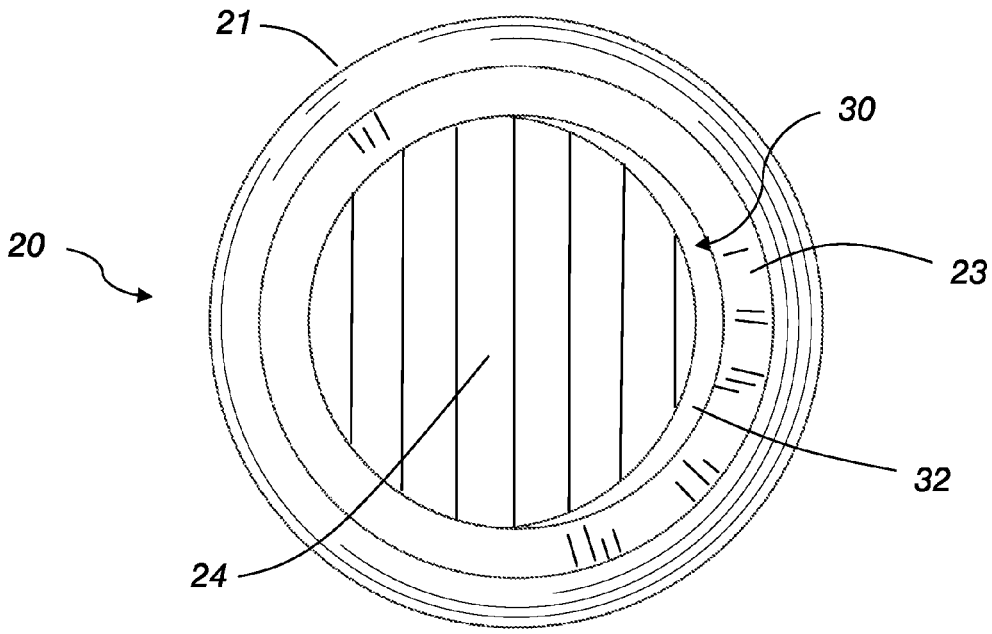
FIG. 8 is a rear view of a firing pin sighting arrangement according to the embodiment of FIG. 1 showing off-sight alignment.
Figure 9:
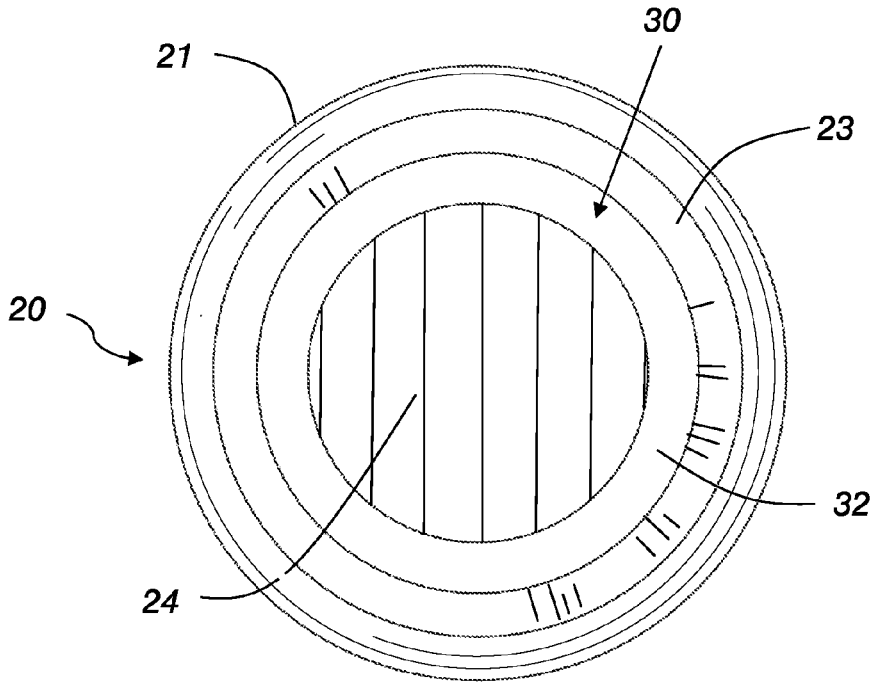
FIG. 9 is a rear view of a firing pin sighting arrangement according to the embodiment of FIG. 1 showing on-sight alignment.

Referring to FIGS. 8-9, the firing pin sighting arrangement 20 further comprises an optical alignment signaling indicia 30. The optical alignment indicia 30 of the preferred embodiment further defines an alignment ring 32. The high contrast sight 24 is concentrically circumposed within the alignment ring 32. The alignment ring 32 of the preferred embodiment is a circular light reflective surface of white paint. The alignment ring 32 may be other colors such as red, yellow, blue, or green, for example. Additionally, the alignment ring 32 may be a number of high contrast light reflective materials such as radioluminous light elements, tritium coated surfaces, phosphorescent material, optically transparent plastic, or fiber-optic plastic, for example. The optical alignment indicia 30 indicates to the shooter when the handgun is either in off-sight alignment or on-sight alignment.

FIG. 8 illustrates a rear view of the firing pin arrangement 20, illustrating off-sight alignment. Off-sight alignment occurs when the main body 12 and barrel 15 of the handgun 11 deviates from the path between the firing pin sighting arrangement 20 and the target with respect to either horizontal or vertical axes. In the present example, the alignment ring 32 provides visible indicia to the shooter of such off-sight alignment. When the barrel 15 is off sight, the alignment ring 32 appears as a crescent, with an arc of the alignment ring concealed by the concentric recess wall 26. The arc of the alignment ring concealed by the concentric recess wall 26 corresponds with the direction of deviation. For example, if the barrel 15 is aligned to the left of the path between the firing pin sighting arrangement 20 and target, the arc of the alignment ring concealed by the concentric recess wall 26 would appear on the left side of the firing pin sighting arrangement 20. Conversely, if the barrel 15 aligned above the path of path between the firing pin sighting arrangement 20 and target, the arc of the alignment ring concealed by the concentric recess wall 26 would appear on the upper side of the firing pin sighting arrangement 20. The size of the arc of the alignment ring concealed by the concentric recess wall 26 appears larger as the angle of deviation of the barrel 15 increases from the target.

As shown in FIGS. 5, 9, on-sight alignment occurs when the barrel 15 of the handgun is aligned with the aim line 40 of the firing pin sighting arrangement 20 and the target. FIG. 9 illustrates a rear view of the firing pin arrangement 20, illustrating on-sight alignment. When the barrel 15 is on-sight, the alignment ring 32 will appear to the shooter as a concentric ring around the high contrast sight 24. Accordingly, the shooter is able to coordinate the handgun 11 from off-sight to on-sight positioning using the firing pin sighting arrangement 20 without the use of a front sight.

Figure 10:
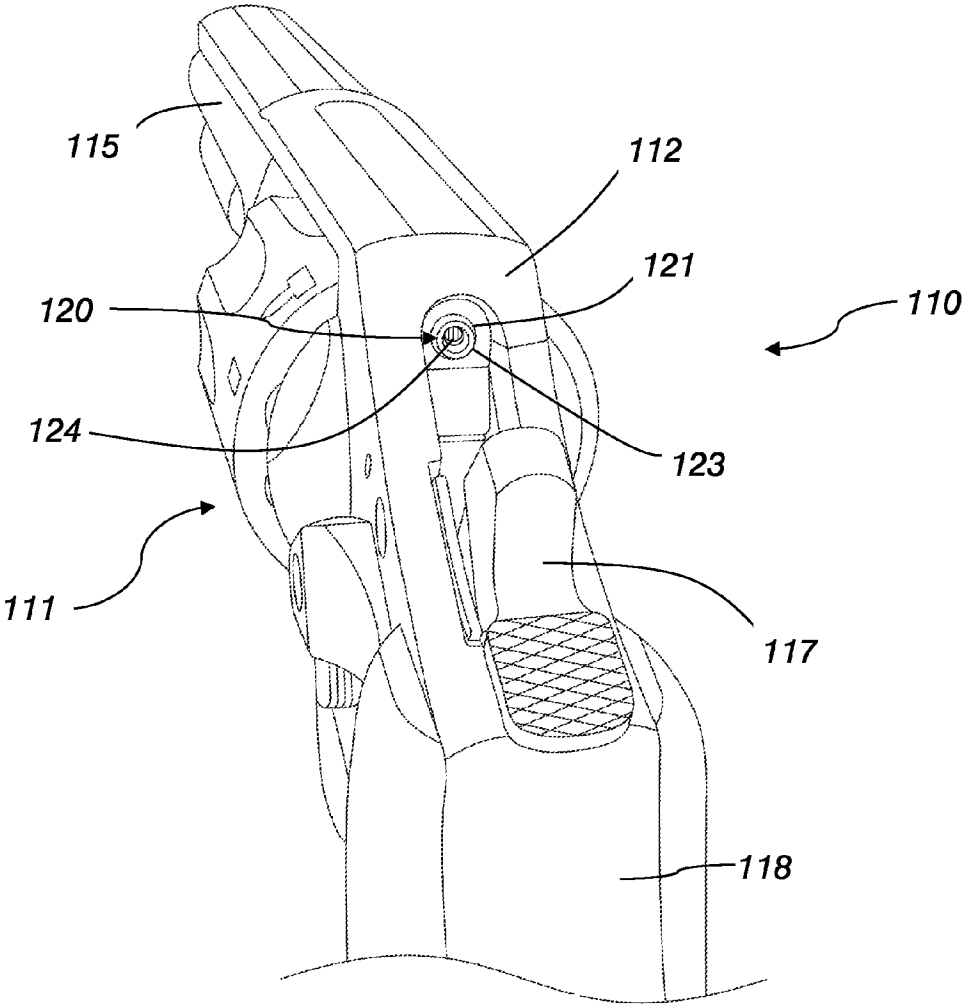
FIG. 10 is a rear perspective view of a firing pin sighting system according to an alternate embodiment of the invention.

Referring to FIG. 10, a firing pin sighting system 110 in accordance with a further embodiment of the invention is illustrated. According to the embodiment, a handgun 111 has a main body 112, defining a barrel 115, a hammer 117, a grip 118, and a firing pin sighting arrangement 120. The firing pin sighting arrangement 120 defines a firing pin 121 having a high contrast sight 124 located on the rear contact surface 123 of the firing pin 121.

Figure 11:
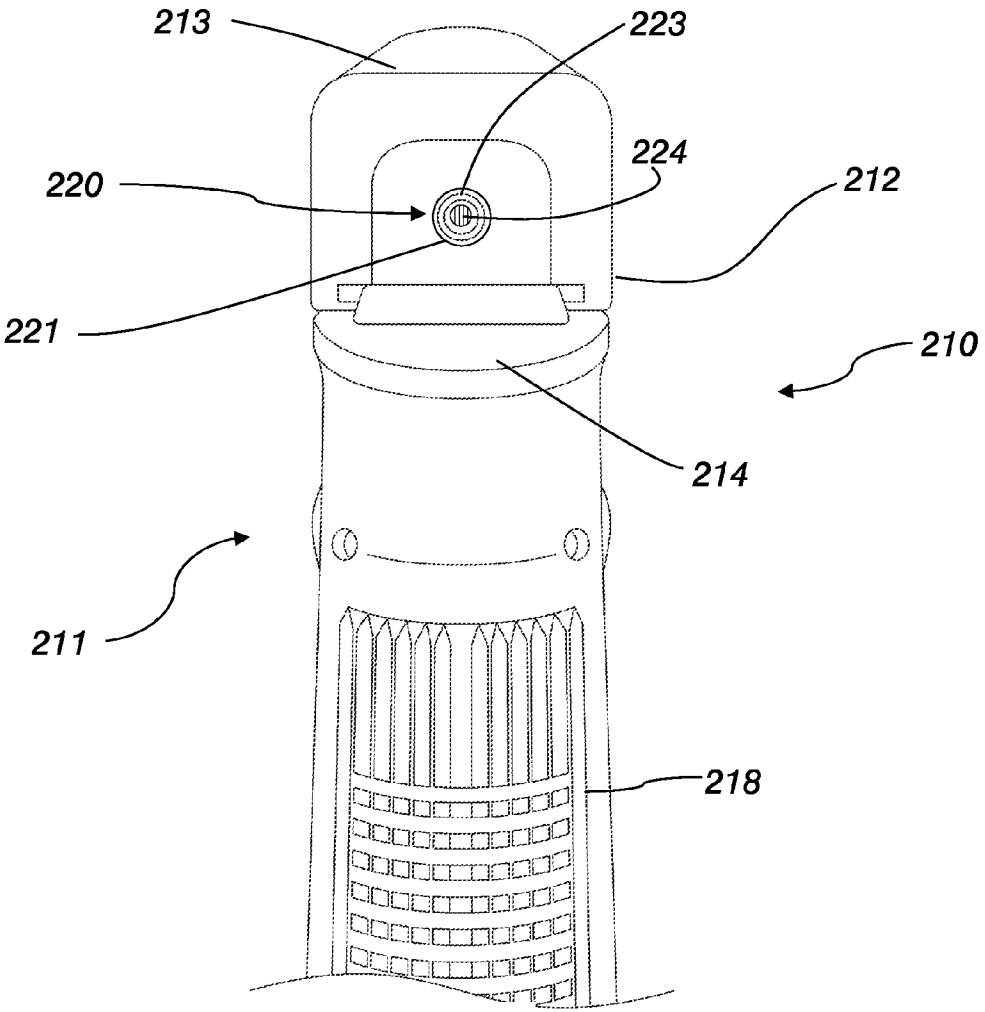
FIG. 11 is a rear view of a firing pin sighting system according to an alternate embodiment of the invention.
Figure 12:
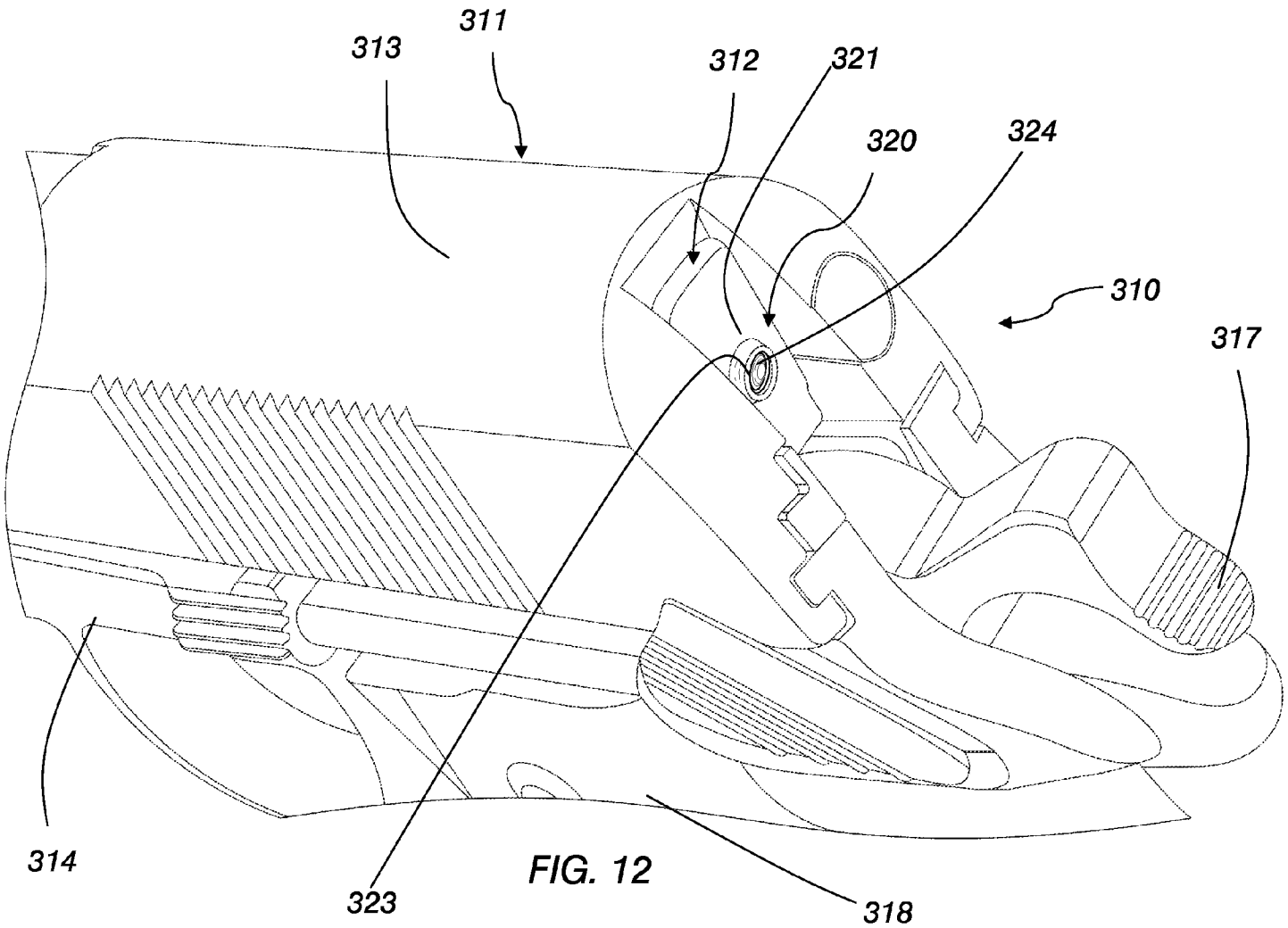
FIG. 12 is a rear perspective view of a firing pin sighting system according to an alternate embodiment of the invention.
Figure 13:
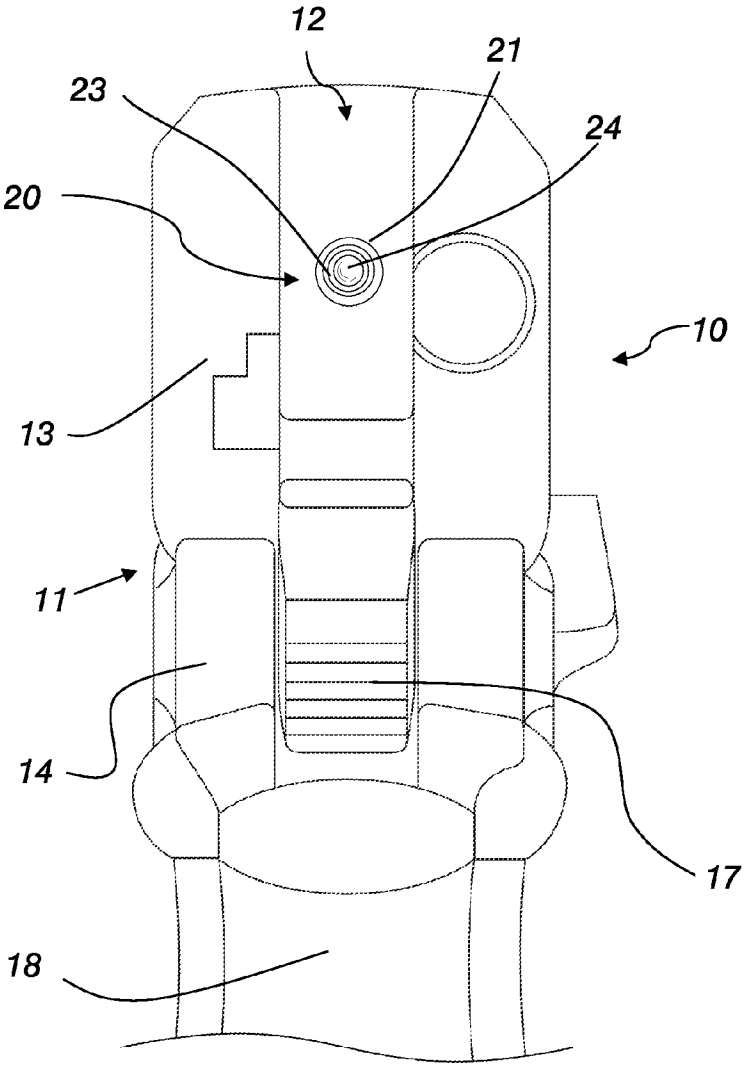
FIG. 13 is a rear view of a firing pin sighting system according to the embodiment of FIG. 12.
Figure 14:
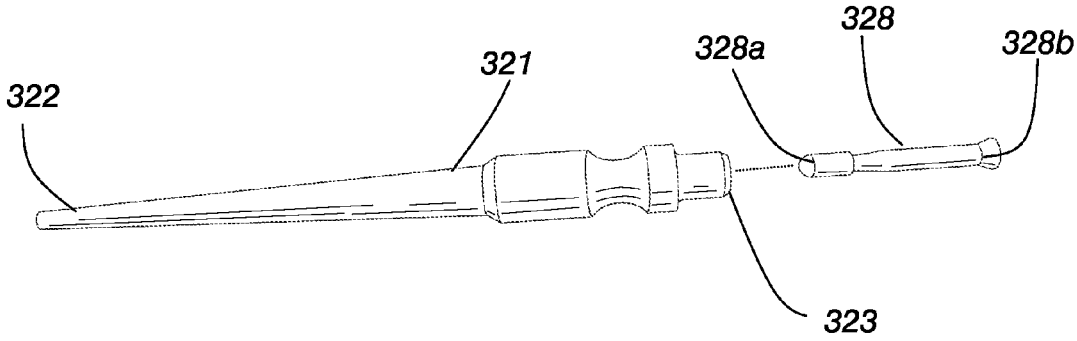
FIG. 14 is an exploded perspective view of a firing pin arrangement and insert, according to the embodiment of FIG. 12.

Referring to FIG. 11, a firing pin sighting system 210 in accordance with a further embodiment of the invention is illustrated. According to the embodiment, a handgun 211 has a main body 212, defining a slide 213 and chassis 214, a grip 218, and a firing pin sighting arrangement 220. The firing pin sighting arrangement 220 defines a firing pin 221 having a high contrast sight 224 located on the rear contact surface 223 of a firing pin 221. According to the embodiment, the firing pin plate cover (not shown) of the handgun 211 is removed such that the firing pin 221 is visible to the shooter from the rear of the handgun 211.

Figure 15:
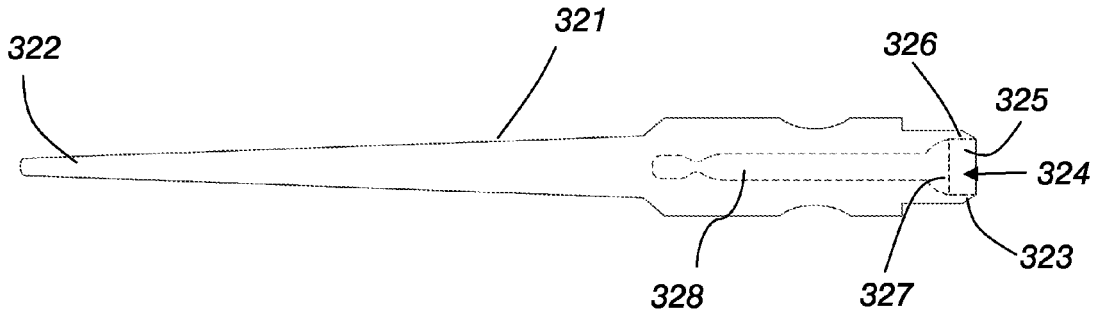
FIG. 15 is a cross-sectional side view of a firing pin arrangement and insert, according to the embodiment of FIG. 12.

Referring to FIGS. 12-15, a firing pin sighting system 310 in accordance with a further embodiment of the invention is illustrated. According to the embodiment, a handgun 311 has a main body 312, defining a slide 313 and chassis 314, a hammer 317, a grip 318, and a firing pin sighting arrangement 320. The firing pin sighting arrangement 320 defines a firing pin 321 having a distal tip 322 and rear contact surface 323, and a high contrast sight 324 disposed within the rear contact surface 323 of the firing pin 321. The rear contact surface 323 defines a circumposed recessed concavity 325 and a concentric recess wall 326 extending into the firing pin 321 from the rear contact surface 323 towards the distal tip 321, creating a lower recess surface 327. A transparent plastic insert 328 is a longitudinally extending light collecting member, disposed within the firing pin 321. The transparent plastic insert 328 has an insert tip 328*a* and an insert end surface 328*b* extending a distance from the lower recess surface 327 towards the distal tip 322. The insert end surface 328*b* rests flush with the lower recess surface 327, as shown in FIG. 15.

Differing combinations and permutations of the embodiments set forth are contemplated by the current invention. Additionally, all functional equivalents of materials used and means of attachment of elements are contemplated by the current invention. Therefore, the spirit and scope of the appended claims should not be limited to the descriptions of the preferred versions and alternate embodiments set forth herein.

Any element in a claim that does not explicitly state "means for" performing a specified function, or "step for" performing a specific function, is not to be interpreted as a "means" or "step" clause as specified in 35 U.S.C. §112, ¶6. In particular, the use of "step of" in the claims herein is not intended to invoke the provisions of 35 U.S.C. §112, ¶6.

What is claimed is:

1. A firing pin sighting system comprising:

a firing pin;

at least one rearwardly facing sight located on a rear surface of said firing pin, said at least one rearwardly facing sight viewable by a shooter a distance from said rear surface of said firing pin;

wherein said at least one rearwardly facing sight is concentrically aligned with the aim line of a round through a barrel of a firearm during firing of said round; and wherein said at least one rearwardly facing sight defines a visible contrast surface with said firearm, allowing said shooter to align said at least one rearwardly facing sight point with a target located in front of said firearm; and wherein the rearwardly facing sight comprises an optical alignment signaling indicia; and the appearance of said optical alignment signaling indicia indicates the alignment of the aim line and the target to the shooter.

2. The firing pin sighting system of claim 1, wherein said rearwardly facing sight comprises a circular painted dot of a selected color.

3. The firing pin sighting system of claim 1, wherein said rearwardly facing sight comprises either of: radioluminous light elements; tritium coated surfaces; phosphorescent material; optically transparent plastic; or fiber-optic plastic.

4. The firing pin sighting system of claim 1, wherein said at least one rearwardly facing sight further comprises a circumposed recessed concavity, and a concentric recess wall extending into said firing pin from said rear contact surface towards said distal tip, creating a lower recess surface, said rearwardly facing sight located at said lower recess surface.

5. The firing pin sighting system of claim 1, further comprising an optical alignment signaling indicia, indicating to the shooter when said firearm is either in off-sight alignment or on-sight alignment.

6. The firing pin sighting system of claim 5, wherein said optical alignment indicia defines an alignment ring.

7. The firing pin sighting system of claim 6, wherein said rearwardly facing sight is concentrically circumposed within said alignment ring.

8. The firing pin sighting system of claim 6, wherein said alignment ring is a circular light reflective surface of white paint contrasting said rearwardly facing sight.

9. The firing pin sighting system of claim 6, wherein said alignment ring is a circular ring of a selected color.

10. The firing pin sighting system of claim 6, wherein said alignment ring is either of: radioluminous light elements, tritium coated surfaces, phosphorescent material, optically transparent plastic, or fiber-optic plastic.

11. The firing pin sighting system of claim 1, wherein said firing pin is positioned for reception of a hammer, said hammer pivotably mounted to strike said rear surface of said firing pin, causing said distal tip to strike a chambered round, causing a shot to be fired.

12. A firing pin sighting system comprising:

a firing pin having opposing ends, defining a distal tip and a rear contact surface;

at least one rearwardly facing sight;

wherein said rear contact surface further defines a circumposed recessed concavity and a concentric recess wall extending into said firing pin from said rear contact surface towards said distal tip, creating a lower recess surface located on said rear contact surface of said firing pin, said at least one rearwardly facing sight located at said lower recessed surface, said rearwardly facing sight viewable by a shooter from the rear of a firearm;

an optical alignment signaling indicia;

wherein said at least one rearwardly facing sight is concentrically aligned with the trajectory path of a round through a barrel of said firearm during firing of a round; and wherein said optical alignment signaling indicia creates a visible contrast surface with said firearm, indicating to said shooter the alignment of said at least one rearwardly facing sight with a target located in front of said firearm.

13. The firing pin sighting system of claim 12, wherein said rearwardly facing sight comprises a circular painted dot of a selected color.

14. The firing pin sighting system of claim 12, wherein said rearwardly facing sight comprises either of: radioluminous light elements; tritium coated surfaces; phosphorescent material; optically transparent plastic; or fiber-optic plastic.

15. The firing pin sighting system of claim 12, wherein said means for optical alignment signaling indicia defines an alignment ring indicating to said shooter when said firearm is either in off-sight alignment or on-sight alignment.

16. The firing pin sighting system of claim 15, wherein said rearwardly facing sight is concentrically circumposed within said alignment ring.

17. The firing pin sighting system of claim 15, wherein said alignment ring is a circular light reflective surface of white paint contrasting said rearwardly facing sight.

18. The firing pin sighting system of claim 15, wherein said alignment ring is a circular ring of a selected color.

19. The firing pin sighting system of claim 15, wherein said alignment ring is either of: radioluminous light elements, tritium coated surfaces, phosphorescent material, optically transparent plastic, or fiber-optic plastic.

20. The firing sighting system of claim 12, wherein said firing pin is positioned for reception of a hammer, said hammer pivotably mounted to strike said rear contact surface, causing said distal tip to strike a chambered round, causing a shot to be fired.

21. A method of handgun sighting, comprising:

presenting a handgun in the frontal plane of a shooter, wherein said handgun is aligned such that a barrel faces a target, and a rear portion of said handgun has a visible firing pin with a high contrast sight located on said visible firing pin, viewable by said shooter; and wherein the high contrast sight comprises an optical alignment signaling indicia; and stereoscopically focusing the vision of said shooter onto said high contrast sight located on said firing pin during target acquisition and sighting of said target; and aligning the handgun using the optical alignment signaling indicia to indicate alignment such that an aim line is in alignment with said barrel and said high contrast sight while maintaining stereoscopic optical focus onto said high contrast sight, such that said high contrast sight is optically projected onto said target in the field of vision of said shooter.

22. The method of handgun sighting of claim 19, further comprising correcting the orientation of the handgun in a vertical and horizontal axis of said aim line according to a optical alignment signaling indicia visible to said shooter, said optical alignment signaling indicia having a high contrast sight point concentrically disposed within a high contrast alignment ring located on said firing pin, said alignment ring optically indicating when the barrel of the handgun is either off-sight or on-sight relative to the path of said aim line and said target.

* * * * *